US010252406B2

(12) United States Patent
Herelier et al.

(10) Patent No.: US 10,252,406 B2
(45) Date of Patent: Apr. 9, 2019

(54) INDIRECT FIRING FASTENING TOOL WITH ANTI-FIRING TRIGGER SUPPORT

(71) Applicant: ILLINOIS TOOL WORKS INC., Glenview, IL (US)

(72) Inventors: Patrick Herelier, Saint Jean DeMuzols (FR); Ludovic Rousson, Saint-Lager-Bressac (FR)

(73) Assignee: ILLINOIS TOOL WORKS INC., Glenview, IL (US)

( * ) Notice: Subject to any disclaimer, the term of this patent is extended or adjusted under 35 U.S.C. 154(b) by 688 days.

(21) Appl. No.: 14/415,156

(22) PCT Filed: Jul. 25, 2013

(86) PCT No.: PCT/US2013/052102
§ 371 (c)(1),
(2) Date: Jan. 16, 2015

(87) PCT Pub. No.: WO2014/018778
PCT Pub. Date: Jan. 30, 2014

(65) Prior Publication Data

US 2015/0202756 A1 Jul. 23, 2015

(30) Foreign Application Priority Data

Jul. 25, 2012 (FR) ..... 12 57198

(51) Int. Cl.
*B25C 1/18* (2006.01)

(52) U.S. Cl.
CPC ..... *B25C 1/188* (2013.01); *B25C 1/184* (2013.01); *B25C 1/186* (2013.01)

(58) Field of Classification Search
CPC ..... B25C 1/188; B25C 1/184; B25C 1/186; B25C 1/008; F16B 21/125; F16B 37/043; F16B 37/842
USPC ..... 227/8, 9–11, 130
See application file for complete search history.

(56) References Cited

U.S. PATENT DOCUMENTS 530,467 A * 12/1894 Balensiefer ..... F41A 19/54 42/43
1,365,869 A * 1/1921 Temple ..... B63C 11/52 102/517
2,679,645 A * 6/1954 Bullwinkle ..... B25C 1/188 227/11
2,773,259 A * 12/1956 Broughton ..... B25C 1/123 227/11

(Continued)

OTHER PUBLICATIONS

ISR for PCT/US2013/052102 dated Jun. 11, 2014.
French Search Report for FR 1257198 dated May 29, 2013.

*Primary Examiner* — Alexander M Valvis
*Assistant Examiner* — Lucas E. A. Palmer
(74) *Attorney, Agent, or Firm* — Thompson Hine LLP

(57) ABSTRACT

An indirect firing fastening tool with an anti-firing trigger support. The tool comprises, in one case, an axially movable equipment with a tip guide projecting from the case to drive a fastening member into a support material, a reception housing for a fastener charger and anti-firing safety means to prevent the recoil of the tip guide. Advantageously, an anti-firing trigger support is mounted on said reception housing to convert the tool into a mono-firing tool, the trigger being arranged to cooperate with the anti-firing safety means so as to remove them and authorize firing.

14 Claims, 3 Drawing Sheets

(56) References Cited

U.S. PATENT DOCUMENTS 3,046,557 A * 7/1962 Broughton ..... B25C 1/123 227/11
3,103,013 A * 9/1963 Bell ..... B25C 1/123 227/11
3,198,412 A * 8/1965 Roosa ..... B25C 1/008 227/109
3,477,629 A * 11/1969 Becht ..... B25C 1/041 227/130
3,540,141 A * 11/1970 Butler ..... B25C 1/186 227/10
3,565,313 A * 2/1971 Hans-Dieter Seghezzi ..... B25C 1/105 227/10
RE27,628 E * 5/1973 Newton et al. ..... B25C 1/087 227/10
3,820,266 A * 6/1974 Larsson ..... B25C 1/105 227/10
3,827,618 A * 8/1974 Oesterle ..... B25C 1/188 227/11
4,189,081 A * 2/1980 Combette ..... B25C 1/14 227/10
4,200,216 A * 4/1980 Maier ..... B25C 1/003 227/126
4,346,831 A * 8/1982 Haytayan ..... B25C 1/001 227/130
4,358,041 A * 11/1982 Ollivier ..... B25C 1/14 227/10
4,597,517 A * 7/1986 Wagdy ..... B25C 1/001 227/120
4,598,851 A * 7/1986 Kopf ..... B25C 1/008 227/10
4,602,608 A * 7/1986 Lacam ..... B25C 1/186 124/31
4,655,380 A * 4/1987 Haytayan ..... B25C 1/143 227/10
4,711,385 A * 12/1987 Jochum ..... B25C 1/14 227/10
4,811,882 A * 3/1989 Steeves ..... B25C 1/008 227/130
4,821,938 A * 4/1989 Haytayan ..... B25C 1/188 227/10
4,930,673 A * 6/1990 Pfister ..... B25C 1/184 227/10
5,035,354 A * 7/1991 Meyer ..... B25C 1/008 227/130
5,167,359 A * 12/1992 Frommelt ..... B25C 1/188 227/8
5,269,640 A * 12/1993 Jonishi ..... F16B 37/043 411/182
5,597,972 A * 1/1997 Wachter ..... B25C 1/184 227/10
5,816,468 A * 10/1998 Yang ..... B25C 1/008 227/120
5,829,661 A * 11/1998 Hirtl ..... B25C 1/184 227/10
6,199,739 B1 * 3/2001 Mukoyama ..... B25C 1/008 227/120
6,264,085 B1 * 7/2001 Ho ..... B25C 1/008 227/120
6,454,152 B1 * 9/2002 Nayrac ..... B25C 1/184 227/120
6,543,664 B2 * 4/2003 Wolfberg ..... B25C 1/008 227/120
6,679,412 B1 * 1/2004 Thomas ..... B25B 23/045 227/119
6,708,860 B1 * 3/2004 Thieleke ..... B25C 1/184 227/119
6,908,021 B1 * 6/2005 Wang ..... B25C 1/008 227/120
6,966,476 B2 * 11/2005 Jalbert ..... B25C 1/003 227/137
6,966,477 B1 * 11/2005 Chien-Kuo ..... B25C 1/005 227/120
7,004,367 B1 * 2/2006 Shen ..... B25C 1/06 173/170
7,070,082 B2 * 7/2006 Ronconi ..... B25C 1/005 227/120
7,980,439 B2 * 7/2011 Akiba ..... B25C 5/1689 227/120
8,104,658 B2 * 1/2012 Yu ..... B25C 5/1665 227/120
8,292,143 B2 * 10/2012 Lee ..... B25C 1/008 227/120
2003/0000990 A1 * 1/2003 White ..... B25C 1/003 227/8
2005/0017046 A1 * 1/2005 Almeras ..... B25C 1/184 227/8
2005/0035172 A1 * 2/2005 Popovich ..... B25C 1/186 227/10
2005/0092808 A1 * 5/2005 Jakob ..... B25C 1/184 227/10
2005/0218175 A1 * 10/2005 Schell ..... B25C 1/188 227/8
2006/0091177 A1 * 5/2006 Cannaliato ..... B25C 1/008 227/8
2006/0157527 A1 * 7/2006 Yamamoto ..... B25C 1/008 227/8
2006/0169735 A1 * 8/2006 Wen ..... B25C 1/008 227/8
2007/0107711 A1 * 5/2007 Leal ..... F41B 11/52 124/71
2007/0290019 A1 * 12/2007 Tille ..... B25C 1/005 227/10
2008/0118302 A1 * 5/2008 Sussenbach ..... F16B 21/075 403/227
2008/0164295 A1 * 7/2008 Wu ..... B25C 1/008 227/8
2008/0179372 A1 * 7/2008 Kurth ..... B25C 1/184 227/136
2009/0072000 A1 * 3/2009 Iijima ..... B25C 1/188 227/109
2010/0170929 A1 * 7/2010 Chang ..... B25C 1/008 227/8
2011/0120739 A1 * 5/2011 Chen ..... B25C 1/06 173/90
2012/0085806 A1 * 4/2012 Lee ..... B25C 1/008 227/8
2012/0305624 A1 * 12/2012 Liao ..... B25C 1/188 227/142

* cited by examiner

INDIRECT FIRING FASTENING TOOL WITH ANTI-FIRING TRIGGER SUPPORT

RELATED APPLICATIONS

The present application is a National Phase of International Application Number PCT/US2013/052102 filed Jul. 25, 2013 which claims priority to French Application Number 1257198 filed Jul. 25, 2012.

The present invention relates to an indirect firing fastening tool through, for example, a powder charge or a gas cartridge.

Such fastening tools (designated by nailing machines) comprise, in one case, an axially movable equipment with a tip guide projecting from the case to drive, through the charge, a fastening member associated with the equipment into a support material. In order to be able to perform successive firings, a fastener charger or store is arranged in a case reception housing and opens into the movable equipment to drive successively the fastening members into the latter through a pusher.

Furthermore, as it is known, these tools are provided with numerous safety devices. In the present case, to avoid operating unnecessarily "off-load" with the fastening tool, anti-firing safety means are provided so that, when a few fastening members only are staying in the charger, the user is advised and replaces the almost empty charger by a full charger. To do so, a locking pivoting lever is connected to the case and engages into a yoke part of the tip guide movable equipment by axially immobilizing said equipment, when the pusher of the charger, with the successive firings, contacts the lever to move it in the tip guide equipment yoke. Firing is thus prevented.

Furthermore, with these usual tools, the tip guide of which has a normal length, it is not practically possible to push the tip guide either with the finger, due to the force of the return spring of the guide in a rest position, or even with the whole hand or a jaw tool like pliers, due to the fact that the tip guide is only projecting a little from the barrel of the equipment of the device.

The problem which is at the base of the invention of the present application does not relate to a usual fastening tool, but to a fastening tool with a quite long tip guide for fastening fasteners like those being used to fasten thick insulation panels that those tip guides must cross. With such tools, an operator could easily grasp the tip guide with the hand or with pliers. The problem of the invention is to prevent, in spite of such characteristic, that an operator cannot push the tip guide towards the tool rear part without having unlocked positively an anti-firing safety.

Thus, the invention relates to an indirect firing fastening tool comprising, in one case, an axially movable equipment with a tip guide projecting from the case to drive a fastening member into a support material, a reception housing for a fastener charger and anti-firing safety means to prevent the recoil of the movable equipment and thus of the tip guide.

According to the invention, the tool is remarkable by the fact that an anti-firing trigger support is mounted on said reception housing to convert the tool into a mono-firing tool, the trigger being arranged to cooperate with the anti-firing safety means so as to remove them and authorize firing.

In particular, when there is an absence of cooperation between the trigger and the anti-firing safety means, the latter are removed from the equipment and authorize firing.

Thus, when the support trigger is in a rest position, the operator, even if he grasps the tip guide, cannot move it backwards up to release firing thanks to the action of the trigger on the pivoting lever of the safety means locking the displacement of the movable equipment. Only a voluntary action of the operator on the support trigger allows the lever of said tip guide movable equipment yoke to be removed and thus the latter to be released.

The trigger support so inserted as a substitution of the charger serves consequently as a control for the anti-firing safety, which is particularly interesting in the case of a long tip guide tool. The operator, by holding the tool with one hand and pushing on the trigger with the other hand, cannot grasp the long tip guide. Only the contact of the latter with the support material by overcoming the usual bearing safety device then allows firing to be released.

Moreover, a usual charger tool is advantageously used and also the safety thereof relative to the presence of fastening members to adapt it to a mono-firing tool by a simple substitution of the charger, using the safety with the trigger support arrangement.

Advantageously, said trigger is pivotally mounted around an axis related to the support and projects from the latter through a slot arranged in the support.

Preferably, said trigger is brought back spontaneously in a rest position through an elastic element provided between the support and the trigger, thereby locking the recoil of the tip guide movable equipment through the safety means.

In particular, said trigger presents a bearing side acting, when the trigger occupies the rest position, on the safety means so as to prevent the recoil of the equipment and being removed from the safety means when the trigger occupies the active position by a voluntary action on the latter.

According to an embodiment, the support is shown under the form of a cover being adapted to the case reception housing and having fasteners being identical to these of the charger, to cooperate with the case. The trigger support may be made of a plastic material which could be reinforced and it is obtained by molding or machining.

The invention also relates to the use of a tool with multiple firings comprising, in one case, a reception housing for a fastener charger and the reception means for a tip guide. Advantageously, to convert said multi-firing tool into a mono-firing tool, a tip guide of a big length is mounted on the tool and anti-firing safety means are acted on to remove them and authorize the recoil of the tip guide.

For example, the operation of the anti-firing safety means is performed through a trigger associated with a support mounted on the case reception housing.

The invention will be better understood with the help of the following description of an indirect firing fastening tool comprising a trigger support according to the invention, referring to the accompanying drawing, wherein.

Figure 1:
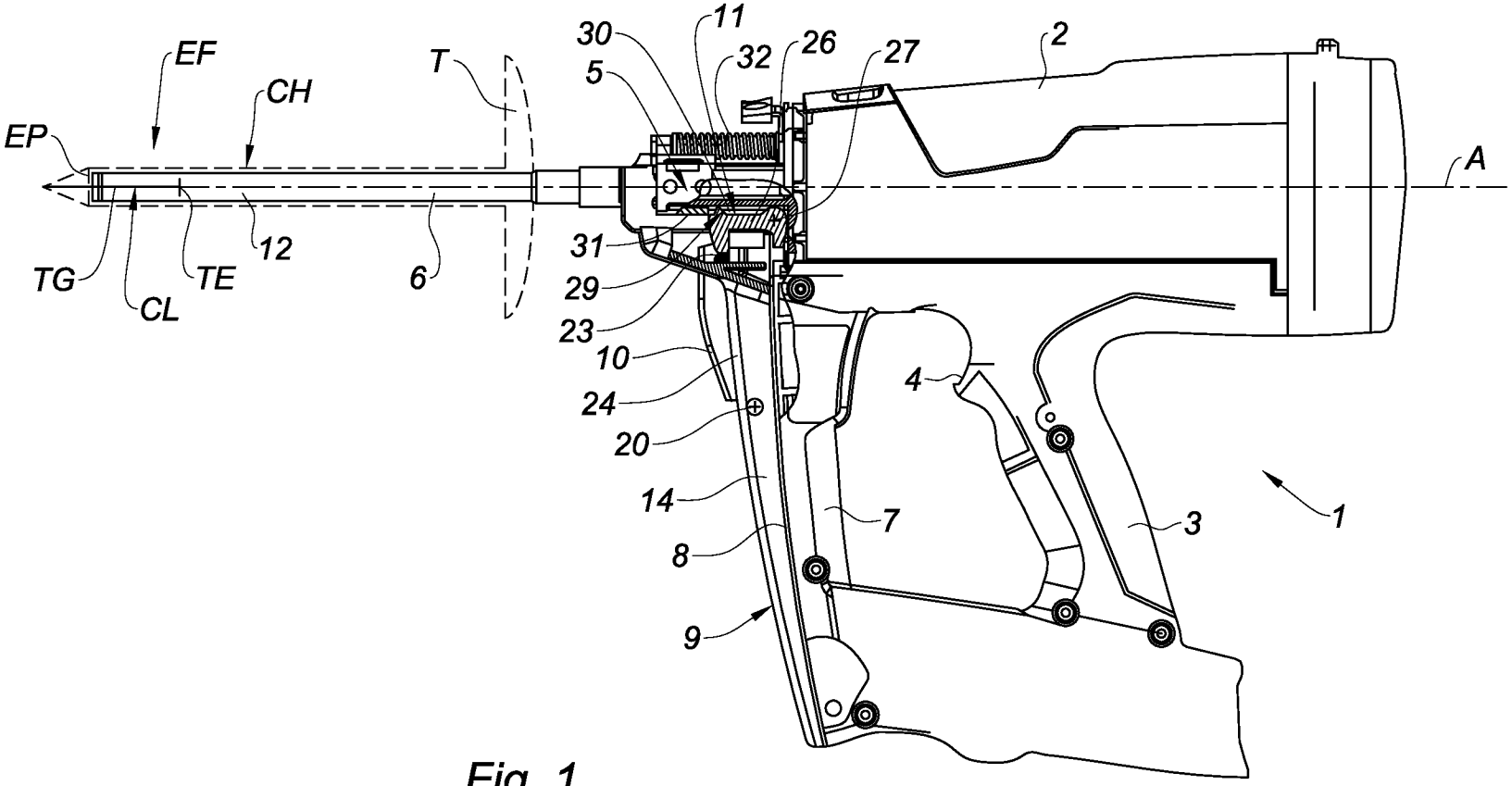
FIG. 1 is a partial longitudinal sectional view of a fastening tool for a fastening member or fastener, with a trigger support according to the invention, in a position of the trigger preventing firing.

The fastening or fixing tool 1 shown herein comprises, in a case 2 extended by a grip 3 with an operating trigger 4 for releasing firing, an axially movable equipment 5 according to an axis A provided with a tip guide 6 with which a fastening member EF cooperates, being intended to be fastened into a support material and to which it will be referred subsequently.

Inside the movable equipment 5, there are, on a usual way not visible on the Figs., a propulsion piston housed in a cylinder of the equipment to drive by sliding in the tip guide the fastening member into the support material, and a source of power such as a powder charge or a gas cartridge to propel the piston.

The fastening tool 1 also comprises, in the front of the latter, ahead the grip 3, a bearing part 7 connected to the housing and forming a housing or a reception location 8 for a fastener charger when the tool is in a configuration with repetitive multi-firings.

Figure 2:
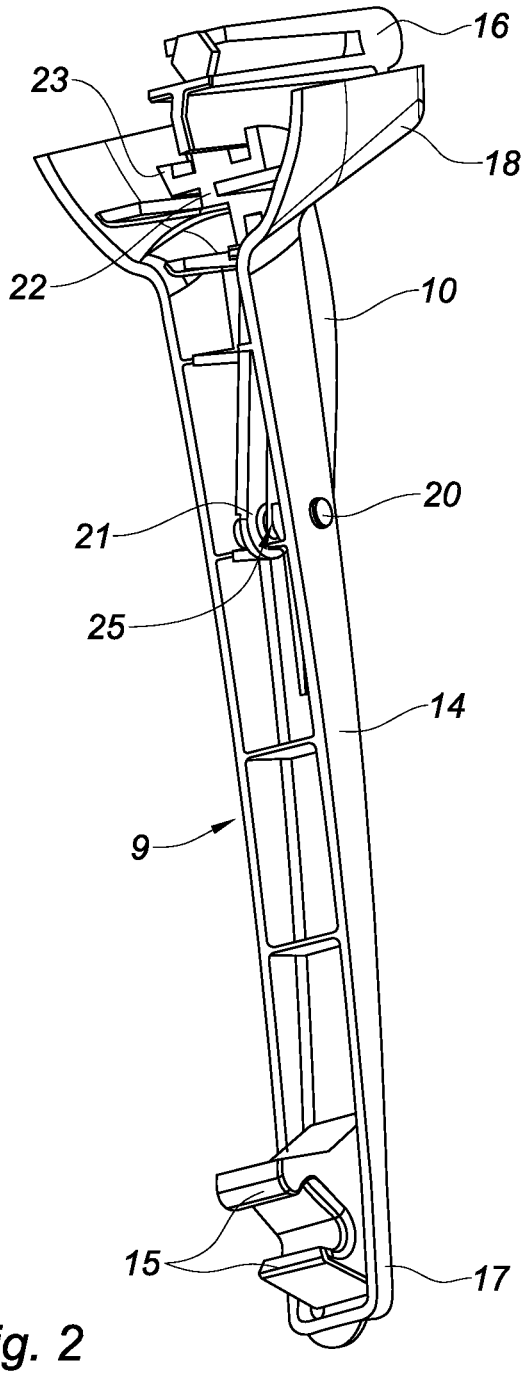
FIG. 2 is a rear perspective view of the trigger support.

Instead of the charger, the tool comprises here, according to the invention, as shown on FIGS. 1 and 2, a support 9 of an anti-firing trigger 10 to convert the multi-firing tool (with a charger) into a mono-firing tool (without any charger, with the trigger support).

To do so, the support 9 is adapted to the housing 8 by fastening on the bearing part 7 and, advantageously, the trigger 10 of the support is arranged to act on anti-firing safety means 11 connected to the tool and provided to lock and prevent the recoil of the movable equipment 5 and thus of the tip guide 6 (as previously recalled, initially such means advise the operator about the exhaustion of the fastening members contained within the charger).

According to the invention, the anti-firing safety means 11 are controlled by the trigger 10 of the support 9. In a first inactive rest position being illustrated on FIGS. 1 and 3, the trigger 10 cooperates with the safety means 11 preventing the recoil of the equipment 5. And, in a second active position illustrated on FIG. 4, the trigger 10, further to a voluntary manual action on the latter, releases the anti-firing safety means 11 which are removed from the equipment and allow the latter to slide, the firing being then able to be released (FIG. 4).

For the reasons above mentioned, such a conversion of the tool into a mono-firing fastening tool 1 is particularly interesting when the member to be fastened EF is long and that the length of the tip guide projecting from the case is then necessarily important to receive such fastening member. Indeed, it is convenient then to avoid the firing triggering by grasping directly the tip guide to move it backwards.

In this example, the fastening member EF is composed of a nail CL housed in the axial passage 12 of the tip guide 6 and of a long dowel CH mounted around the tip guide and intended to be arranged through a thick insulator to fix it to the support material by the nail. The dowel CH and the nail CL are schematically represented in a thick dashed line on FIG. 1. It is seen that the dowel extends on the tip guide with its head T (or collar) near the nose of the case 2 of the tool, whereas the stem TG of the nail aims at crossing axially the dowel to be driven, when firing is validated, into the support material, the head TE of the nail coming in contact with an internal shoulder EP of the dowel, thereby pushing the latter against the material.

The support 9 represented on FIGS. 1 and 2 is supposed to cover the housing or the front place 8 of the bearing part 7 and it is presented as an extended cover 14 having attachment or fastening members 15, 16 similar to those provided on the chargers for such tool.

Thus, it is seen on FIG. 2 that the lower end 17 and the higher end 18 of the extended cover 14 comprise attachment elements, such as locking pins 15, 16 able to be engaged into complementary reception areas provided for that purpose on the bearing part 7 and the case 2 of the tool.

The trigger 10 under the form of an extended flat lever is pivotally mounted around a joint axis 20 at the level of its lower end 21, whereas its higher end 22 is ended by a bearing side or flat 23 able to cooperate with the safety means 11. In order to handle the trigger from the outside, a slot 24 being partially crossed by the flat trigger 10 is arranged in the cover of the support 9. The joint axis 20 is orthogonal to the longitudinal axis A of the movable equipment 5, and a torsional spring 25, a branch of which can be seen on FIG. 2, is mounted around the axis 20 to act on the cover and the trigger so that the latter is brought back spontaneously to the first rest or starting position, projecting from the cover.

As an example, the support 9 and the trigger 10 are made in a plastic material which can be reinforced and the support is obtained by moulding or machining. It presents, as it can be seen on FIG. 2, a C-shaped cross-section or similar with a rim applying against the bearing part 7 so as to match at the best to the profile of the latter by extending it appropriately.

Regarding now the anti-firing safety means 11 connected to the case, they comprise in this example a pivoting lever 26 mounted on an axis 27 cooperating with the case and arranged orthogonally to the longitudinal axis A and parallel to the axis 20 of the trigger 10 of the support. Such pivoting lever 26 presents on its free end 28 a projecting part or pin 29 able to engage into a cutout 30 arranged in a yoke-shaped part 31 surrounding a fixed support 34 of the tip guide 6 and which is connected to the movable equipment 5 on a sliding way.

Furthermore, the pivoting lever 26 is itself subjected to the action of a torsional spring, not visible on Figs., tending to bring back spontaneously the pivoting lever in the anti-clockwise direction, as it will be seen subsequently on FIGS. 3 and 4, that is to say to move the projecting pin 29 away from the cutout 30 of the yoke 31.

Figure 3:
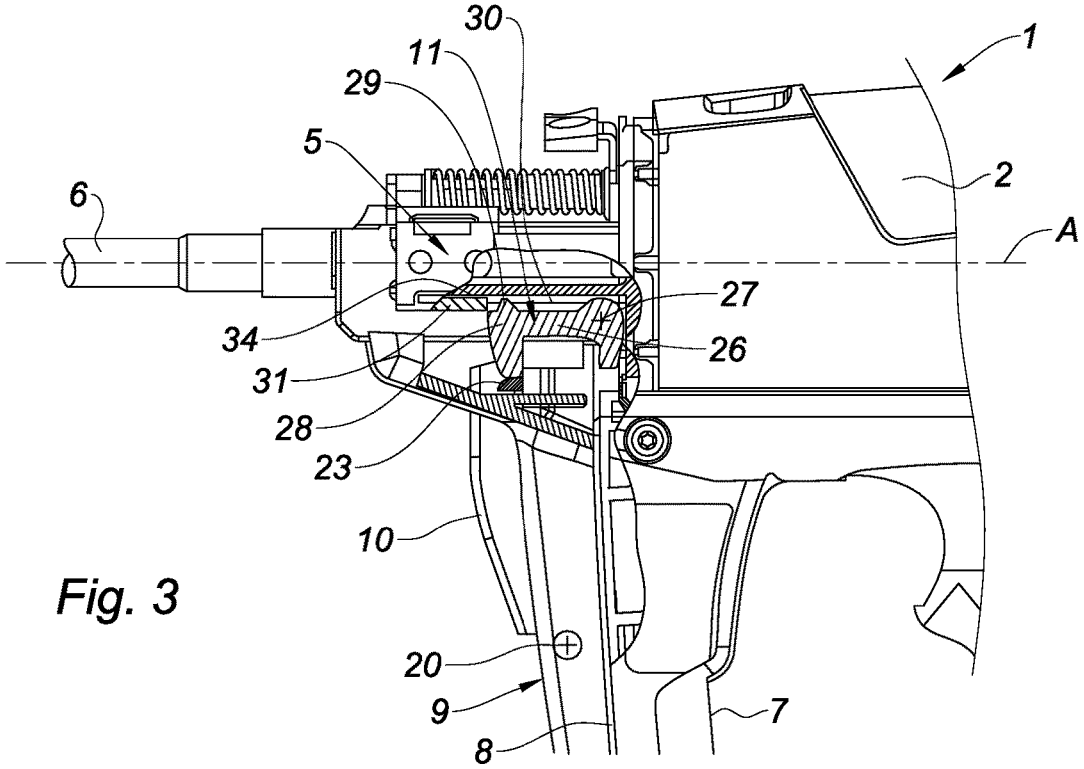
FIG. 3 is a partial enlarged view of said tool of FIG. 1, in particular of the trigger support received in a tool housing and showing the trigger in the position preventing firing.
Figure 4:
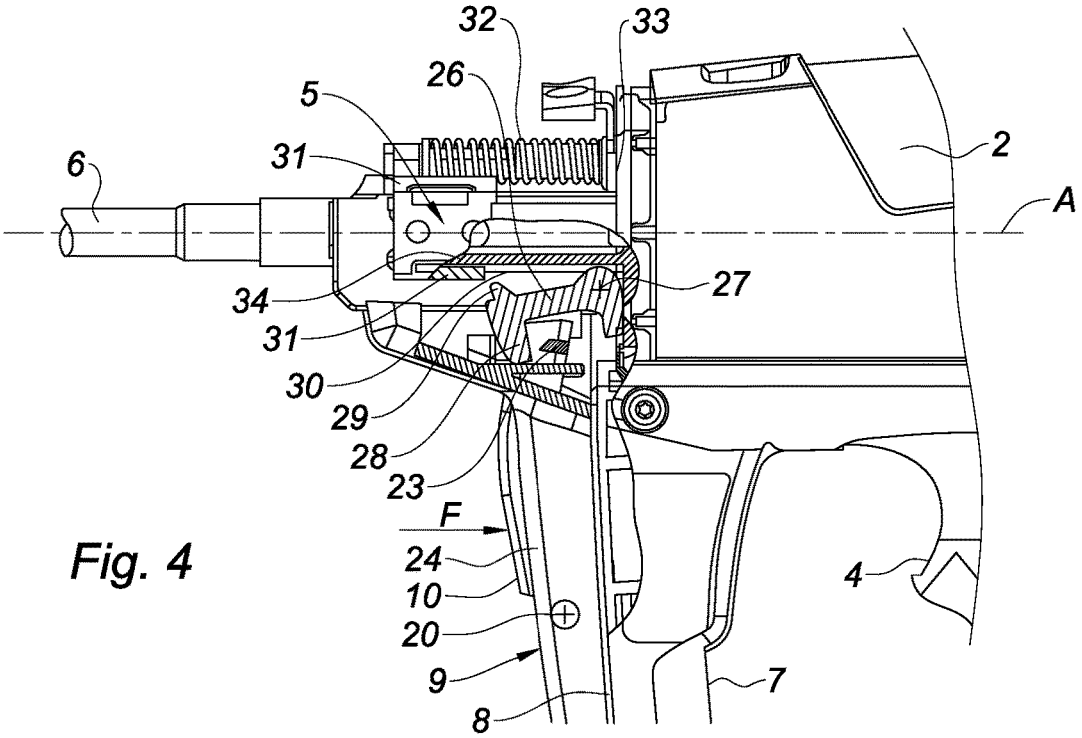
FIG. 4 is a view similar to FIG. 3, showing the trigger in the position authorizing firing.

Referring to FIGS. 1 and 3, when the cover 14 forming the support 9 is engaged into the reception housing 8 of the case, the trigger 10 mounted on the axis 20 occupies, under the action of the spring 25, the first inactive rest position.

In such position, the flat 23 of the trigger applies under the free end 28 of the lever 26 by pivoting it around the axis 27. In such a way, the projecting pin 29 ending such free end becomes engaged into the cutout 30 of the yoke 31.

As the latter is connected to the movable equipment 5, the tip guide 6 cannot be moved backwards axially by the operator, the lever 26 locking in position the movable equipment 5.

The support 9 of the trigger 10 thus reaches its object to prevent the recoil of the tip guide of a big length, even if the operator holding the tool by the grip 3, grasps the tip guide with his free hand.

To be able to make the firing, the operator must first act on the trigger 10 of the support.

By pushing on the trigger 10 (arrow F, FIG. 4), the latter pivots around the axis 20 in opposition to the action of the torsional spring 25 and enters in great part in the cover 14 through the slot. The rotation of the trigger 10 leads to the remoteness of the flat 23 from the free end 28 of the locking lever 26.

The latter, under the action of the torsional spring being not visible on the Figs., pivots around the axis 27 in the anti-clockwise direction, that is to say that the projecting pin 29 is moving away from the cutout 30 of the yoke 31, as shown on FIG. 4. It is thus understood that, as long as the operator maintains pressure on the trigger 10 of the support 9, the movable equipment 5 with the tip guide 6 is axially unlocked and cannot then move backwards.

At that time only, the operator can start firing by pushing on the firing control trigger 4. Of course, prior to firing authorization, the operator applies the free end of the tip guide with the fastening member EF (dowel and nail) mounted on the latter against the support material to overcome the usual bearing safety of the tool 1. For example, a compression spring 32 plays as such bearing safety while being provided between the part 31 of the movable equipment and the transversal side 33 of the nose ending the case 2.

It is only by activating such safety and by holding a bearing on the trigger 10 releasing the lever 26 that the operator, also pushing on the control trigger 4 of the tool 1, indicates that firing is authorized. The piston propelled by the source ejects the nail which is driven into the support material while fastening the dowel.

The trigger support then reaches its objective, namely to allow the conversion of a repetitive firing fastening tool with a charger into a mono-firing fastening tool with a tip guide of a great length for fastening members, the support being in functional relationship with usual anti-firing safety means, preventing the recoil of the tip guide as long as the trigger of said support is not pushed on.

The invention claimed is:

1. An indirect firing fastening tool comprising, in one case, an axially movable equipment with a tip guide projecting from the case to drive a fastening member into a support material, a reception housing defining a mount location for a fastener charger, and anti-firing safety means having a safety position that engages with the movable equipment to prevent the recoil of the tip guide, wherein an anti-firing trigger support is mounted at the mount location on said reception housing, wherein the anti-firing trigger support carries an anti-firing trigger having a rest position in which a part of the anti-firing trigger engages in cooperating contact with the anti-firing safety means to position the anti-firing safety means in the safety position to convert the tool into a mono-firing tool, wherein the anti-firing trigger is manually movable from the rest position to an active position that removes the cooperating contact between the part and the anti-firing safety means and permits movement of the anti-firing safety means to a release position that is disengaged from the movable equipment so as to authorize firing by permitting recoil of the tip guide.

2. The tool according to claim 1, wherein, the anti-firing trigger is carried on the anti-firing trigger support such that removal of the anti-firing trigger support from the mount location separates the anti-firing trigger from the tool while the anti-firing safety means remains on the tool.

3. The tool according to claim 1, wherein said anti-firing trigger is pivotally mounted on the anti-firing trigger support for pivot around an axis and projects from the anti-firing trigger support through a slot arranged in the anti-firing trigger support.

4. The tool according to claim 3, wherein said anti-firing trigger automatically moves back to the rest position, when manual activation of said anti-firing trigger is released, through an elastic element provided between the anti-firing trigger support and the anti-firing trigger, so that the anti-firing safety means is again moved to the safety position to prevent the recoil of the tip guide.

5. The tool according to claim 1, wherein a joint axis of the anti-firing trigger is orthogonal to an axis of the movable equipment.

6. The tool according to claim 1, wherein the anti-firing trigger support is present under the form of a cover being adapted to the reception housing and having fasteners that engage with the case.

7. The tool according to claim 6, wherein the anti-firing trigger support is made of a plastic material obtained by molding or machining.

8. An indirect firing fastening tool comprising:

an axially movable equipment including a tip guide configured to drive a fastening member into a support material, a reception housing defining a mount location for a fastener charger;

an anti-firing safety lever pivotally mounted on the tool and movable between a safety position and a release position, in the safety position the anti-firing safety lever engages with the equipment and blocks recoil of the tip guide, and in the release position the anti-firing safety lever does not block recoil of the tip guide; and an anti-firing trigger support that is mounted at the mount location on said reception housing, the anti-firing trigger support carrying an anti-firing trigger that is movable between a rest position and an active position, in the rest position a part of the anti-firing trigger engages with and holds the anti-firing safety lever in the safety position, in the active position the part of the anti-firing trigger disengages from the anti-firing safety lever to permit movement of the anti-firing safety lever out of the safety position and into the release position to authorize firing by permitting recoil of the tip guide.

9. The indirect firing fastening tool of claim 8, wherein:

the anti-firing safety lever pivots about a first axis;

the anti-firing trigger is mounted to the anti-firing trigger support for pivot about a second axis that is spaced apart from the first axis.

10. indirect firing fastening tool comprising:

an axially movable equipment including a tip guide configured to drive a fastening member into a support material;

a reception housing defining a mount location for a fastener charger;

an anti-firing safety lever pivotally mounted on the tool and movable between a safety position and a release position, in the safety position the anti-firing safety lever engages with the equipment and blocks recoil of the tip guide, and in the release position the anti-firing safety lever does not block recoil of the tip guide; and an anti-firing trigger support that is mounted at the mount location on said reception housing such that the anti-firing trigger support must be removed in order for the tool to receive a fastener charge at the mount location, the anti-firing trigger support carrying an anti-firing trigger that is movable between a rest position and an active position, in the rest position a part of the anti-firing trigger engages with and holds the anti-firing safety lever in the safety position, in the active position the part of the anti-firing trigger disengages from the anti-firing safety lever to permit movement of the anti-firing safety lever out of the safety position and into the release position.

11. The tool of claim 10 wherein:

a linear movement axis of the equipment extends from a body of the tool and forward toward a free end of the tip guide;

a grip extends downward from the body of the tool and is below the linear movement axis;

the reception housing extends downward from the body of the tool and is positioned forward of the grip and below the linear movement axis, such that the anti-firing trigger support mounted at the mount location positions the anti-firing trigger below the linear movement axis and forward of the grip.

12. The tool according to claim 11, wherein said anti-firing trigger is pivotally mounted on the anti-firing trigger support for pivot around a first axis and projects from the anti-firing trigger support through a slot arranged on a forward facing side of the anti-firing trigger support.

13. The tool according to claim 12, wherein the anti-firing safety lever is pivotal about a second axis that is spaced above the first axis and below the linear movement axis.

14. The tool according to claim 13, wherein the anti-firing trigger is carried on the anti-firing trigger support such that removal of the anti-firing trigger support from the mount location separates the anti-firing trigger from the tool while the anti-firing safety lever remains on the tool.

* * * * *